US007743885B2

(12) United States Patent
Martin et al.

(10) Patent No.: US 7,743,885 B2
(45) Date of Patent: Jun. 29, 2010

(54) LOAD BEARING SYSTEM, AND AN ARTICLE INCLUDING SUCH LOAD BEARING SYSTEM

(75) Inventors: Ian Martin, Squamish (CA); Thomas Walker Clarke Fayle, North Vancouver (CA)

(73) Assignee: ARC'TERYX Equipment Inc., North Vancouver, BC (CA)

( * ) Notice: Subject to any disclaimer, the term of this patent is extended or adjusted under 35 U.S.C. 154(b) by 1050 days.

(21) Appl. No.: 11/452,318

(22) Filed: Jun. 14, 2006

(65) Prior Publication Data

US 2007/0209869 A1 Sep. 13, 2007

(30) Foreign Application Priority Data

Mar. 9, 2006 (EP) ..... 06004821

(51) Int. Cl.
*A62B 35/00* (2006.01)

(52) U.S. Cl. ..... 182/3; 182/4; 182/230; 2/338; 442/2

(58) Field of Classification Search ..... 182/3, 182/4, 230; 428/98, 192, 193; 442/37, 120; 28/146, 170; 24/38, 304; 156/304.3; 206/411; 2/275, 310, 311, 338; 450/86, 90
See application file for complete search history.

(56) References Cited

U.S. PATENT DOCUMENTS 129,928 A * 7/1872 Burt ..... 24/38
703,568 A * 7/1902 Gaisman et al. ..... 2/322
726,670 A * 4/1903 Geisel ..... 24/38
949,519 A * 2/1910 Cardell ..... 24/34
1,255,594 A * 2/1918 Geisel ..... 474/258
1,261,118 A * 4/1918 Beisel ..... 24/38
1,328,406 A * 1/1920 Van Alstyn ..... 2/314
1,373,457 A * 4/1921 Smith ..... 474/258
1,477,084 A * 12/1923 Smith ..... 474/258
1,770,742 A * 7/1930 Moore ..... 2/314
1,903,406 A * 4/1933 Putvin ..... 24/38
2,122,623 A * 7/1938 Rogers ..... 28/143
2,494,646 A * 1/1950 Crawshaw ..... 139/420 R
3,122,755 A * 3/1964 Rosen et al. ..... 2/221
3,234,611 A * 2/1966 Paasche ..... 24/38
3,316,017 A * 4/1967 Knight ..... 297/483
3,415,703 A * 12/1968 Burgess ..... 156/304.4
3,444,957 A * 5/1969 Ervin, Jr. ..... 182/3
3,481,807 A * 12/1969 Kanamori ..... 156/159
3,487,871 A * 1/1970 Kanamori ..... 156/266

(Continued)

OTHER PUBLICATIONS

U.S. Appl. No. 11/205,076, unpublished, Daniel Allan Green et al.

*Primary Examiner*—Katherine W Mitchell
*Assistant Examiner*—Colleen M Quinn
(74) *Attorney, Agent, or Firm*—Greenblum & Bernstein, P.L.C.

(57) ABSTRACT

A load bearing system including a load-bearing textile strap, including an article, such as a backpack or a climbing harness, that includes such load bearing system. The strap includes at least one woven portion and at least one non-woven portion. The woven portion has warp yarns extending along a longitudinal direction of the strap interlaced with at least one weft yarn, the woven portion having a first width. In the non-woven portion the warp yarns are spread transversely so that the non-woven portion has a second width greater than the first width of the woven portion.

30 Claims, 5 Drawing Sheets

U.S. PATENT DOCUMENTS 3,713,174 A * 1/1973 Boussac ..... 2/74
3,937,407 A * 2/1976 Matsuo ..... 244/151 R
4,015,035 A * 3/1977 Blad et al. ..... 428/60
4,177,522 A * 12/1979 Auburn ..... 2/338
4,298,648 A * 11/1981 Turnbull ..... 428/195.1
4,325,999 A * 4/1982 Campman et al. ..... 428/112
4,370,784 A * 2/1983 Turnbull ..... 28/166
4,427,107 A * 1/1984 Roberts et al. ..... 198/844.2
4,756,942 A * 7/1988 Aichele ..... 428/102
5,039,168 A * 8/1991 Baymak et al. ..... 297/471
5,091,243 A * 2/1992 Tolbert et al. ..... 442/60
5,467,802 A * 11/1995 Lusen et al. ..... 139/384 R
5,507,682 A * 4/1996 Grahammer ..... 450/86
6,328,080 B1 * 12/2001 Winters ..... 139/388
6,533,066 B1 * 3/2003 O'Dell ..... 182/3
7,331,363 B2 * 2/2008 Lanzi ..... 139/422
7,354,876 B2 * 4/2008 Porter et al. ..... 442/172
2004/0069565 A1 * 4/2004 Luke et al. ..... 182/3
2005/0015944 A1 1/2005 Bergeron
2005/0189169 A1 * 9/2005 Tanaka et al. ..... 182/3

* cited by examiner

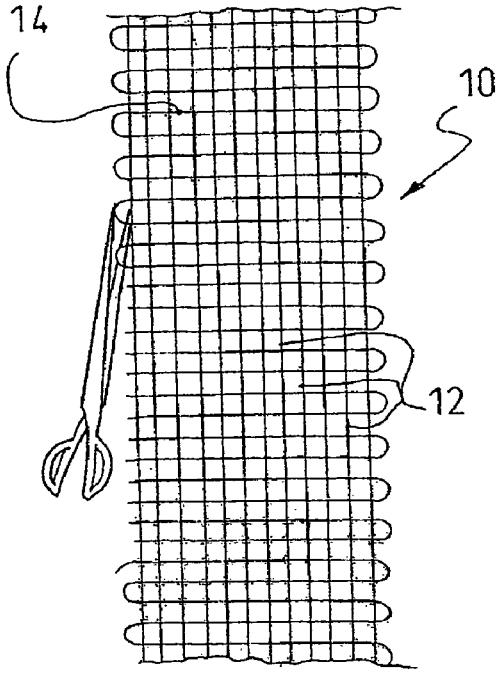
Fig. 5
Fig. 6
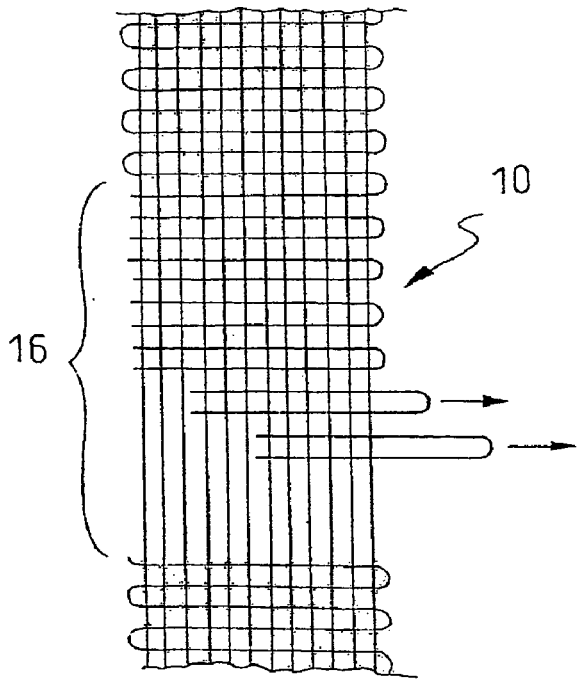

LOAD BEARING SYSTEM, AND AN ARTICLE INCLUDING SUCH LOAD BEARING SYSTEM

CROSS-REFERENCE TO RELATED APPLICATION

This application claims priority under 35 U.S.C. §119 of European Patent Application No. 06004821.2, filed on Mar. 9, 2006, the disclosure of which is hereby incorporated by reference thereto in its entirety.

BACKGROUND OF THE INVENTION

1. Field of the Invention

The invention relates to a load bearing system that includes a load bearing textile strap.

More particularly, the invention is directed to such a strap for any application in which a load is required to be spread along a contacting surface. For example, such applications include those in which an object is to come in contact with a portion of a body of a person using such object, such as climbing harnesses, backpack shoulder straps, backpack hip belts, ski pole straps, medical slings, automobile seat belts, bag carrying straps, etc.

The invention is also directed to other categories of applications, such as, for example, industrial lifting slings. Indeed, in such applications, the load-spreading feature according to the invention, further described below, can be implemented to considerable advantage with regard to the load bearing system of the invention and the object with which it comes into contact.

2. Description of Background and Relevant Information

In current applications that use a load-bearing strap, a cushioning pad may be provided adjacent the strap, so that the cushioning pad is interposed between the strap and the user's body in order to avoid direct contact. The cushioning pad is sometimes wider than the load-bearing strap, but usually by only small amount if at all. Moreover, the cushioning pad being basically soft, it has a significant load-spreading effect only very close to the edges of the strap. Therefore, the load is not properly spread and may result in too much contact pressure on the body, causing undesirable effects.

In order to achieve better spreading of the load, it is known to use variable width textile straps. Such straps are woven in a specific way at predefined positions along their length, most of the time by modifying the weaving parameters in a specific section of the strap. Typically, such techniques allow the width of the strap to be increased at those specific predefined locations up to double the nominal width of the strap, but not more. Such techniques increase the production cost of the strap and they show no flexibility: once the strap is woven, the location, shape, and measurements of the portions of increased width cannot be adjusted to each specific application.

Such variable width straps do achieve a load spreading effect, but they are limited by the maximum width increasing ratio. Other constraints include having to weave a specific strap for each specific application.

SUMMARY OF THE INVENTION

In view of the current state of the art, an object of the invention is to provide a new construction for a load bearing system which achieves a desired load bearing effect in an easy, flexible, low-cost and effective way.

Toward this end, the invention provides for a load bearing system that includes a load bearing textile strap, the strap including a woven portion having warp yarns extending along a longitudinal direction of the strap interlaced with at least one weft yarn, the woven portion of the strap having a first width, the strap having a non-woven portion including only at least a part of the warp yarns, and, in the non-woven portion, the warp yarns being spread transversely so as to spread over a second width greater than the first width of the woven portion.

BRIEF DESCRIPTION OF THE DRAWINGS

Other characteristics and advantages of the invention will be better understood upon reading the following description, with reference to the attached drawings showing, by way of non-limiting embodiments, how the invention can be embodied, and in which:

FIGS. 5 and 6 are schematic drawings showing a simple and economical process for removing the weft yarn(s) in a portion of a conventional woven strap;

DETAILED DESCRIPTION OF THE INVENTION

Figure 1:
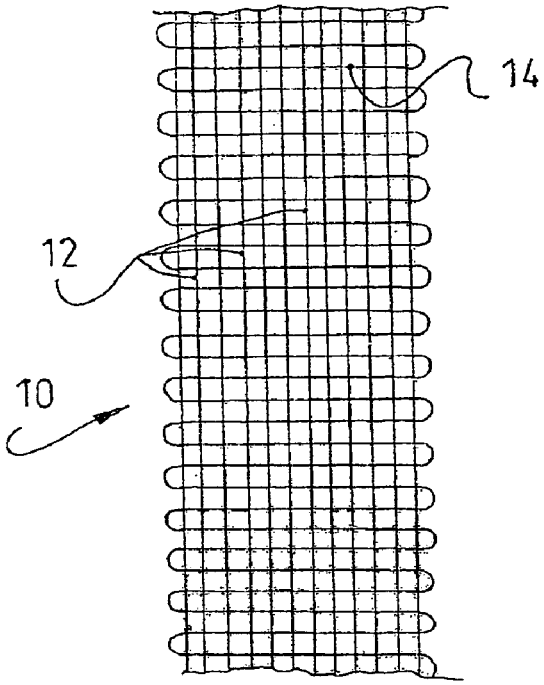
Fig. 1 Prior Art
FIG. 1 is a schematic view of one example of a conventional woven strap.

FIG. 1 shows, very schematically, a woven strap 10. Generally, the strap 10 includes a series of warp textile yarns 12 which all extend substantially parallel one to another along the longitudinal direction of the strap. As in any woven textile, at least one weft textile yarn 14 is provided which is interlaced with the warp yarns 12, in that it extends transversely back and forth across the width of the strap, passing over some of the warp yarns and under other warp yarns. It is well known that diverse weaving patterns can be used (plain weave, twill weave, satin weave, etc.), each of them having various sorts of possible variations and elaborations. The strap could also be woven with several weft yarns. In each case, however, the weft yarn(s) 14 is (are) continuous and, where a weft yarn reaches the edge of the series of warp yarns, it turns back in the opposite transverse direction, again being interlaced with the warp yarns 12.

Because FIG. 1 is a schematic diagram, it does not show that, in a woven strap, the warp and weft yarns are preferably tightly woven so that in fact no void space is visible between the yarns. Moreover, with certain weaving patterns, a strap can be made which seemingly exhibits several superimposed layers of warp yarns, the layers being interconnected or not by the weft yarn. It also is known to have a special weaving/knitting of the weft and warp yarns along the edges of the strap, mainly in order to provide an additional locking effect of the weft yarn on the edge warp yarns. Such locking ensures that the strap does not unravel totally if the weft yarn breaks at one point of the strap. In the drawings, the warp and weft yarns appear to be of the same nature and size, but it is of course common to use different warp and weft yarns, and also to use different warp yarns along the width of the strap, for example using warp yarns along the edges of the strap.

The woven portion of the strap has a first width. Although the first width could vary along the length of the woven portion (as known in the prior art), the first width is substantially constant along the length of the non-woven portion.

According to one aspect of the invention, a strap 10 is provided having a portion in which the weft yarn is absent, that is, a non-woven portion 16.

Figure 2:
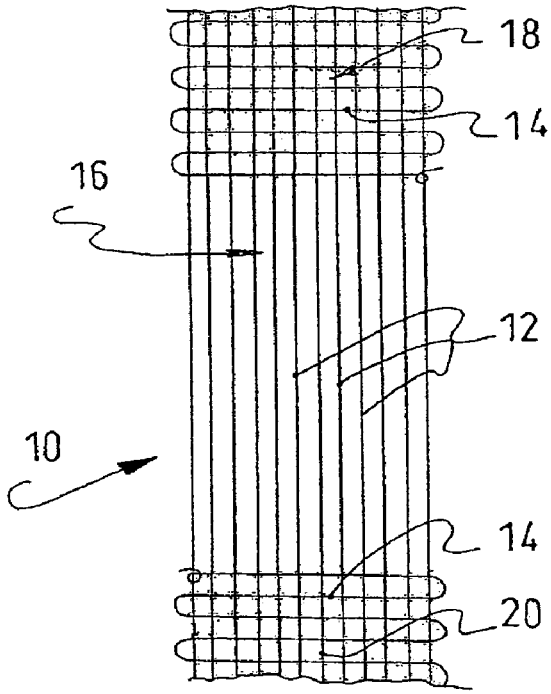
FIG. 2 is a schematic view of the strap of FIG. 1 whereby, in one aspect of the invention, in an intermediate portion of the strap, the weft yarn(s) has (have) been removed, forming an intermediate non-woven portion.

In the example shown in FIG. 2, the non-woven portion 16 is an intermediate portion of the strap between two woven portions 18, 20. In the illustrated example, the non-woven portion 16 of the strap has only warp yarns 12 extending along the longitudinal direction of the strap 10. The warp yarns 12 are continuous with the warp yarns 12 of the two woven portions 18, 20 adjacent the non-woven portion. In the illustrated example, all the warp yarns of both woven portions are continuous through the non-woven portion. Nevertheless, it could be chosen that only a portion of the warp yarns 12 of the woven portions 18, 20 are continued through the non-woven portion 16.

Such non-woven portion 16 could be made simply by interrupting the weaving process, namely by interrupting the interlacing of the weft yarn(s) with the warp yarns on the weaving loom, while allowing the warp yarns to advance through the loom. Therefore, after a first upstream woven portion 18 has been woven, the weaving process would be interrupted for a period of time corresponding to the time necessary for the desired length of the non-woven portion to advance through the loom. Then, the weaving process would resume in order to weave the adjacent downstream woven portion 20. A strap 10 with a built-in non-woven intermediate portion 16 could therefore be directly produced in such way.

In FIGS. 5 and 6 is shown an alternative and very simple method to make a non-woven portion 16 in an initially continuously woven strap as shown in FIG. 1. According to the invention, the weft yarn(s) 14 is (are) simply removed in a particular portion of the strap. In order to do so, it is sufficient to cut the weft yarn(s) 14 along one of the edges of the woven strap 10. As shown in FIGS. 5 and 6, if a weft yarn 14 is cut at two of its consecutive reversing locations at the edge of the strap 10, then the weft yarn forms, between the two cut-outs, something like a "U pin" with only the legs of the U of such pin interlaced with the warp yarns. The "U pin" is virtually not locked any more to the warp yarn and can be easily pulled out. If the strap has been woven with an additional locking effect along the edges of the strap, as described above, the locking weave/knit usually involves only one or a few warp yarns along each edge of the strap, and for facilitating commercialization, it may be simpler to cut also those warp yarns at each of the longitudinal ends of the desired non-woven portions and to remove them together with the weft yarn(s).

A particular advantage of this process is that it is possible to use almost any standard strap, so that the strap can be sourced in great quantities for a variety of applications. Indeed, with a given standard strap, it is very easy to adjust the length and position of the non-woven portion(s) relative to the length and position of the woven portions, keeping full flexibility in the choice of the base strap depending on the application. To the contrary, a ready-made strap with built-in non-woven portions would not exhibit such flexibility.

The cutting of the weft yarn(s) may be done manually, as indicated in FIG. 5, for example with scissors or with a knife, or it can be done with a specific tool, for example a die-cut, or even with a machine such as a laser cutting machine. Manual operations provide a particular flexibility, in that the exact length and position of the non-woven portion can be easily determined at the precise location of the cutting. Operations performed with a specific tool or machine can provide greater productivity, while requiring a degree of preparation.

Figure 3:
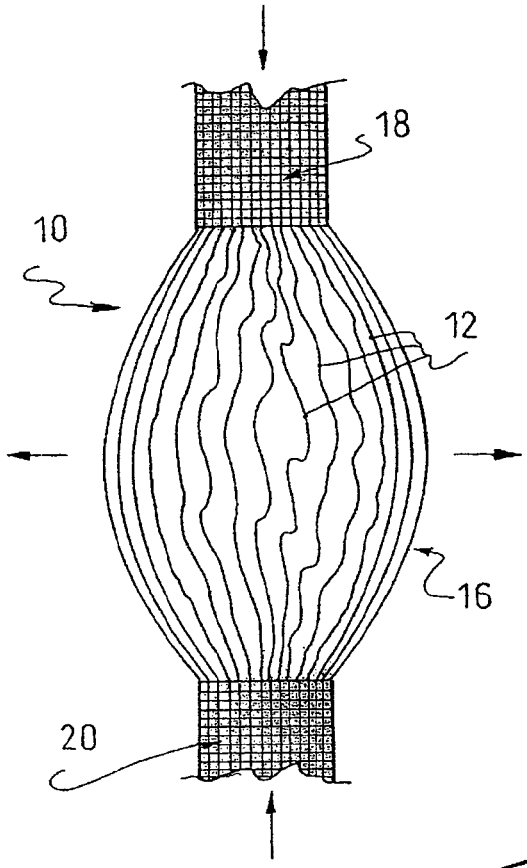
FIG. 3 is a schematic view of the strap of FIG. 2 whereby, in the intermediate non-woven portion, the warp yarns have been spread transversely.
Figure 4:
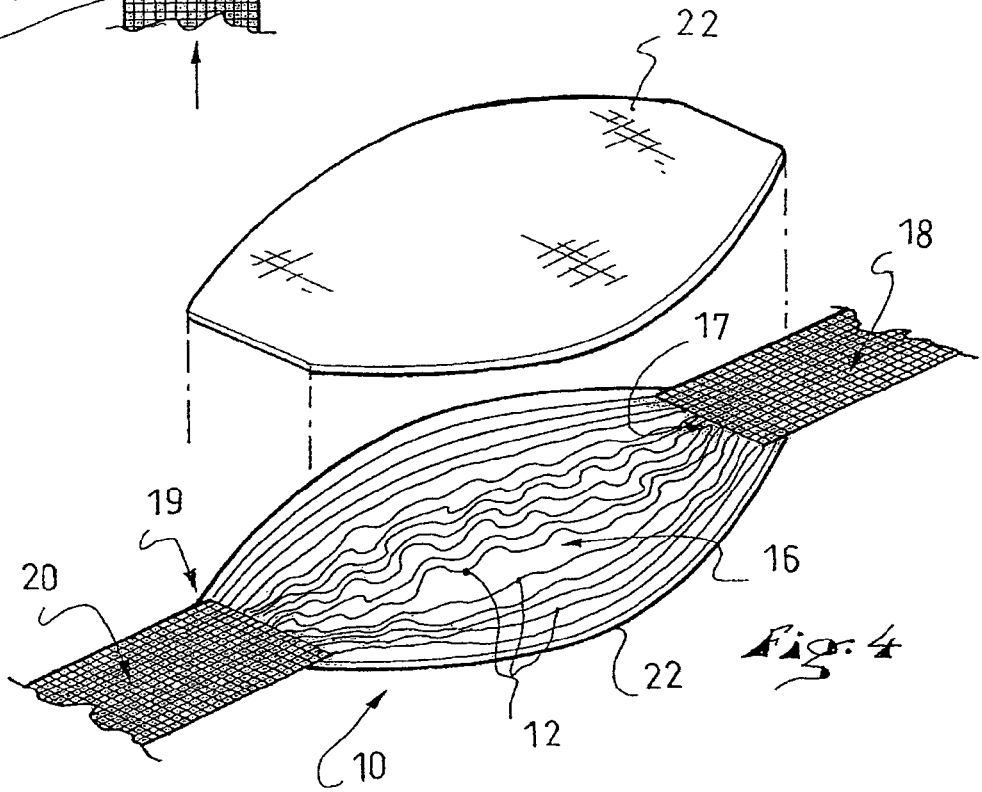
FIG. 4 is a schematic perspective view of the strap of FIG. 3, showing how the warp yarns of the non-woven portion may be adhesively bonded on a support surface.

As can be seen in FIGS. 3 and 4, the warp fibers of the non-woven portion of the strap can be spread transversely and maintained transversely spread apart.

Various techniques can be used to maintain the warp yarns in the spread-apart configuration.

One such technique that can be employed is to make a series of transverse stitches to stitch the warp yarns 12 to a support surface. Such support surface can be any kind of textile material, or a laminate material, or a film, or other support surface.

According to one alternative aspect of the invention, however, the warp yarns 12 can be very effectively maintained in their spread-apart configuration by adhesive bonding.

Depending upon the materials making up the yarns, different adhesive bonding techniques can be used. It is within the scope of the invention that, if the materials are compatible, the yarns can be affixed on a support surface by welding, for example ultrasonic or radio-frequency welding. However, in most cases, the adhesive bonding can be achieved through the use of adhesive materials such as glues or glue-containing compounds. Many types of glues can be used, such as, for example, polyurethane based glues. Such glues can be in the form of self-standing films or in liquid form. They can be thermo-activated glues, e.g., hot-melt glues. A glue-containing compound, for example, can be made of two or more films of hot-melt adhesive, including films of different compositions to adapt to the specific materials of the warp yarns on one side and of a support surface on the other side. The gluing compound could also possibly have an interfacial layer between two adhesive films. The interfacial layer could, for example, be a fabric layer or a foam layer.

In the illustrated example, the adhesive bonding is achieved through the use of a self-standing film of thermo-activated polyurethane glue 22. The film is, for example, pre-cut to a desired shape (which here corresponds to the shape of the non-woven portion 16 of the strap 10 and its spread-apart warp yarns 12) and simply heat-pressed onto the strap. By means of such heat pressing, the glue flows very intimately around each yarn and secures each yarn very solidly. Indeed, in contrast with a tightly woven web, where the tight interlacing might prevent the glue from perfectly bonding to the fibers (unless a perfect match of temperature, glue flow rate and glue quantity is achieved), the spread-apart warp yarns can be relatively easily perfectly bonded. That is, as can be seen in FIGS. 3 and 4, for example, each of pluralities of adjacent pairs of warp yarns 12 are spaced apart in the non-woven portion 16 of the strap 10 greater than they are spaced apart in the woven portions 18, 20 so that the glue can flow between the individual warp yarns of each of such pairs.

As shown in FIG. 4, according to the invention, the non-woven portion 16 can be sandwiched between two films of hot-melt glue 22.

In any case, in a particular aspect of the invention, the glue film(s) has (have) a length greater than the length of the non-woven portion in order to cover not only the non-woven portion 16, but also neighboring parts 17, 19 of the woven portions 18, 20. Indeed, the film of glue therefore not only maintains the warp yarns 12 in a spread-apart configuration, but also prevents the terminal transverse edges of the woven portions 18, 20 from fraying.

The strap therefore exhibits a load-spreading portion of having an increased second width compared to the first width of the woven portion. The load-spreading portion is made without compromising the amount of load that the strap can withstand since the warp yarns 12, which bear most of the load, are continuous through both woven portions 18, 20 and through the non-woven portion 16.

The strap and its load-spreading portion can be totally or partially encased in a flexible casing or envelope made, for example, of two sheets of textile material joined along their respective edges. The load-spreading portions of the strap can, in such an embodiment, be glued inside the casing.

Adjacent the load-spreading portion of the strap, according to another embodiment, a cushioning layer can be provided, such as a foam layer, for example. Such cushioning layer can be glued onto the load-spreading portion. In case the load-spreading portion is encased in a casing, the cushioning layer may be contained, for example, within the casing.

The embodiment described above has a non-woven portion in an intermediate location between two woven portions of the strap.

Figure 7:
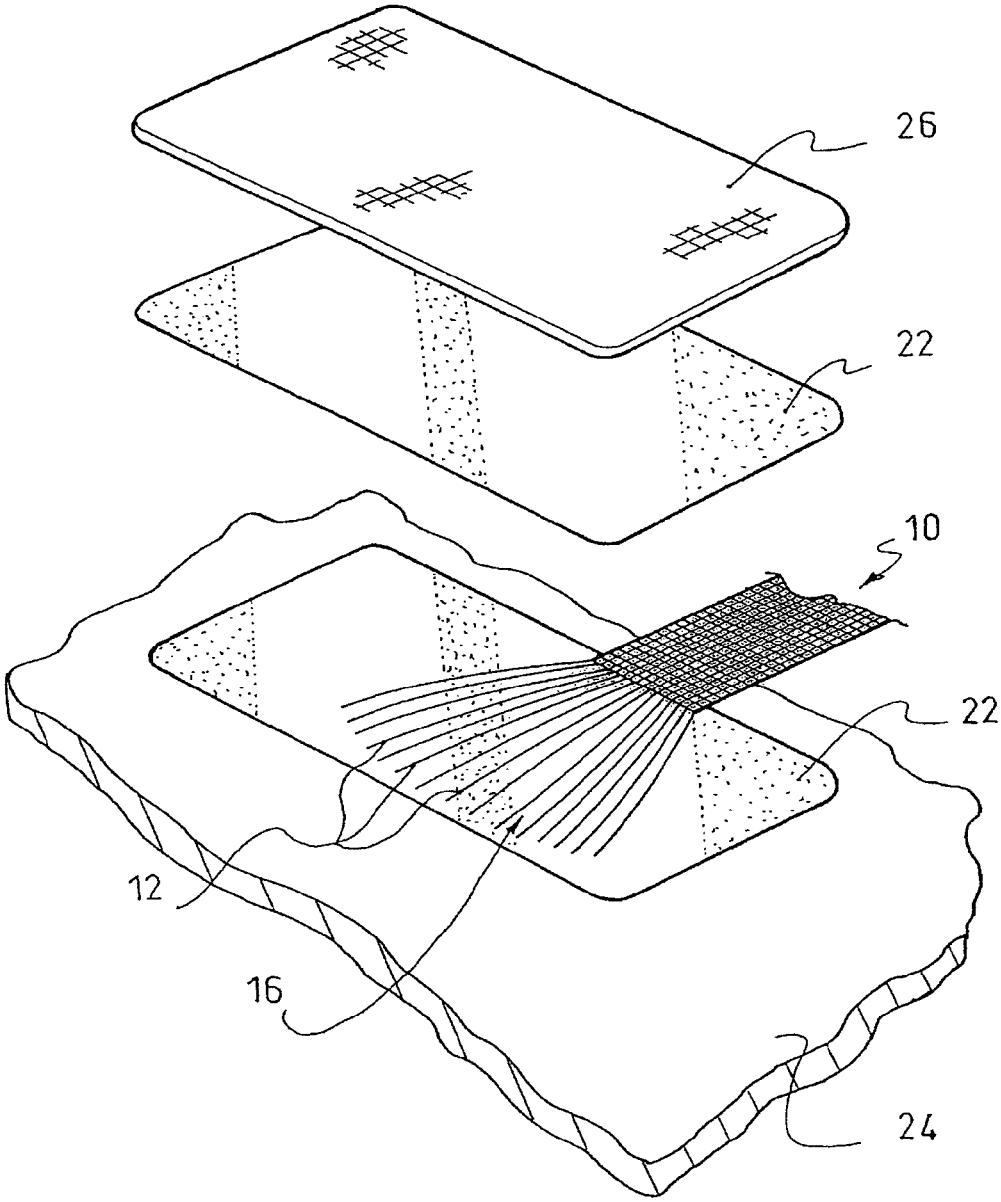
FIG. 7 is a schematic perspective view of another embodiment of the invention whereby the non-woven portion is an end portion of the strap.

FIG. 7 illustrates an embodiment in which the non-woven portion is an end portion of the strap, which end portion is to be connected to a support surface 24 in order to transfer the load to the support surface 24.

An embodiment like that of FIG. 7 can be used, for example, when connecting a load-bearing strap to a backpack waist-belt, or other article to which a load-bearing strap can be connected for support.

In such an embodiment, it can be seen in FIG. 7 that the warp yarns 12 of the non-woven portions have free ends (i.e., ends not connected to another woven portion), that are spread angularly apart as in a fan. Such fanned end portion can be glued on the support surface 24 via any of the techniques described above (for example by using a thermo-activated sheet of glue, or simply by stitching), and it can also be covered by a covering layer 26, which itself can be glued thereon with another sheet of glue 22.

Figure 8:
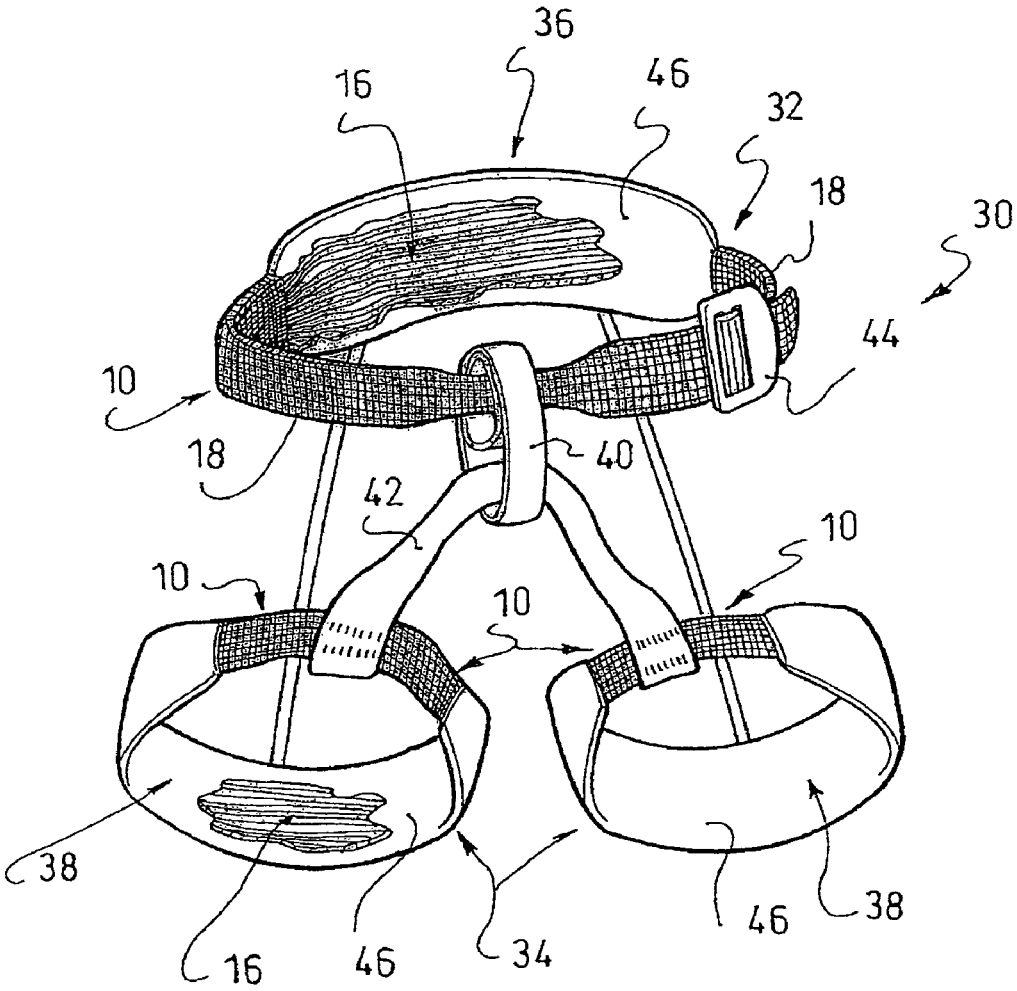
FIG. 8 is a schematic perspective view of a climbing harness equipped with a load bearing system according to the invention.

An exemplary application of the invention is shown in FIG. 8, with the load bearing system being integrated in a climbing harness 30. The climbing harness 30 has, for example, a waist belt 32 and two leg loops 34. The waist belt 32 and the two leg loops 34 each have a rear comfort part 36, 38, respectively, of greater width (relative to other portions of the straps thereof) which is intended to transfer most of the contact pressure between the harness 30 and the corresponding parts of the user's body, respectively the lumbar part of the back and the back of the thighs.

A securing ring 40 is secured on the front part of the waist belt and a link strap 42 connects the two leg loops 34 while passing through the securing ring 40.

As can be seen in FIG. 8, the waist belt 32 includes a load bearing system according to the invention. A load-bearing textile strap 10 encircles the waist of the user and is closed on itself in an adjustable manner through the adjustable buckle 44. According to the invention, the strap 10 is a woven strap having a non-woven portion 16. Advantageously, the non-woven portion 16 is located in the rear comfort zone 36 of the waist belt 32, in order to give it its enlarged width. In the illustrated example, the non-woven portion 16 of the strap is encased in a textile casing 46 (partially cut-out in the drawing to show the non-woven portion of the strap). The front part of the strap, and particularly the connecting zone where the adjustment buckle 44 is located, is made up of two woven portions 18 of the strap 10.

The two leg loops 34 are constructed in a similar way with a load-bearing strap 10 which is closed on itself (here in a non-adjustable manner, for example through adequate stitching of the two woven extremities of the strap), the strap having a non-woven back portion 16 (also encased in a supple/flexible casing 46) intended to come in contact with the back of the user's thighs.

A climbing harness constructed as described above and shown in FIG. 8 is extremely light in weight while remaining comfortable to wear, as a result of the load-spreading effect of the non-woven portion of the strap.

The incorporation of the load bearing system in a climbing harness can be varied according to many different embodiments, within the scope of the invention. For example, only the waist belt or only the leg loops can be constructed using a load bearing system according to the invention.

The load bearing system according to the invention can also be incorporated into a backpack, such as for shoulder strap(s) and/or a hip belt thereof, including into a backpack such as in accordance with the disclosure of U.S. Patent Application Publication No. 2006/0283907, published on Dec. 21, 2006, and commonly owned herewith, the disclosure of which is hereby incorporated by reference thereto in its entirety. For example, the load bearing system according to the invention could be incorporated in an intermediate portions of the shoulder straps 26 and/or of the straps 38, 40 of the hip belt of that application.

Other applications of the invention are also contemplated, whereby the load-bearing system described herein can be incorporated into various articles, such as backpack shoulder straps and/or hip belts, industrial lifting slings, ski pole straps, gear slings, gun straps, musical instrument straps, medical slings, etc., and for any application in which a load bearing strap is currently used.

The invention claimed is:

1. A load bearing system comprising:

a load-bearing textile strap;

said strap comprising a woven portion having warp yarns extending along a longitudinal direction of the strap interlaced with at least one weft yarn, said woven portion of the strap having a first width;

said strap having a non-woven portion, said non-woven portion of the strap comprising only at least a portion of the warp yarns;

in said non-woven portion of the strap, said warp yarns being transversely spread over a second width greater than said first width of the woven portion; said warp yarns being maintained transversely spread by: adhesive bonding, or being attached to a support surface with stitches.

2. A load bearing system according to claim 1, wherein:

said warp yarns of said non-woven portion of the strap are maintained transversely spread by adhesive bonding.

3. A load bearing system according to claim 1, wherein:

said warp yarns of said non-woven portion of the strap are maintained transversely spread by being adhesively bonded to a support surface.

4. A load bearing system according to claim 2, wherein:

said warp yarns of said non-woven portion of the strap are maintained transversely spread by being adhesively bonded with a film of glue.

5. A load bearing system according to claim 1, wherein:

said warp yarns of said non-woven portion of the strap are maintained transversely spread by being attached to a support surface with stitches.

6. A load bearing system according to claim 1, wherein:

said non-woven portion of the strap is an end portion of the strap.

7. A load bearing system according to claim 1, wherein:
said non-woven portion of the strap is an intermediate portion of the strap, between two woven portions of the strap, said intermediate portion of the strap having warp yarns extending along a longitudinal direction of the strap interlaced with at least one weft yarn.

8. A load bearing system according to claim 1, wherein:
said non-woven portion of the strap is encased in a flexible casing.

9. A load bearing system comprising:
a load-bearing textile strap;
said strap comprising a woven portion having warp yarns extending along a longitudinal direction of the strap interlaced with at least one weft yarn, said woven portion of the strap having a first width;
said strap having a non-woven portion, said non-woven portion of the strap comprising only at least a portion of the warp yarns;
in said non-woven portion of the strap, said warp yarns are spread transversely over a second width greater than said first width of the woven portion;
a cushioning pad positioned adjacent said non-woven portion of the strap.

10. A load bearing system according to claim 9, wherein:
said cushioning pad is adhesively bonded to the non-woven portion of the strap.

11. A load bearing system according to claim 1, wherein:
said non-woven portion of the strap includes no weft yarn extending from said woven portion of the strap.

12. A load bearing system comprising:
a load-bearing textile strap;
said strap comprising a woven portion having warp yarns extending along a longitudinal direction of the strap interlaced with at least one weft yarn, said woven portion of the strap having a first width;
said strap having a non-woven portion, said non-woven portion of the strap comprising only at least a portion of the warp yarns;
in said non-woven portion of the strap, said warp yarns are spread transversely over a second width greater than said first width of the woven portion;
said load-bearing strap comprises a strap of a climbing harness.

13. A load bearing system according to claim 1, wherein:
said load-bearing strap comprises a shoulder strap of a backpack.

14. A load bearing system according to claim 1, wherein:
said load-bearing strap comprises a waist belt of a backpack.

15. A climbing harness comprising:
at least one of a waist belt and a pair of leg loops; at least one of the waist belt and the pair of leg loops comprising
a load-bearing textile strap;
said strap comprising a woven portion having warp yarns extending along a longitudinal direction of the strap interlaced with at least one weft yarn, said woven portion of the strap having a first width;
said strap having a non-woven portion, said non-woven portion of the strap comprising only at least a portion of the warp yarns;
in said non-woven portion of the strap, said warp yarns are spread transversely over a second width greater than said first width of the woven portion.

16. A climbing harness according to claim 15, wherein: the climbing harness comprises said waist belt, said waist belt comprising said load-bearing textile strap.

17. A climbing harness according to claim 15, wherein:
the climbing harness comprises said pair of leg loops,
each of said leg loops comprises a load-bearing strap according to claim 15.

18. A load bearing system according to claim 1, wherein:
said comprising only at least a portion of the warp yarns in said non-woven system consists of all or fewer than all said warp yarns extend through said non-woven portion of the strap; and
none of the at least one weft yarn extends within said non-woven portion of the strap.

19. A load bearing system according to claim 1, wherein:
said warp yarns of the strap extend continuously along both said woven portion and said non-woven portion of the strap.

20. A load bearing system according to claim 1, wherein:
each of pluralities of adjacent pairs of said warp yarns are spaced apart in said non-woven portion of the strap greater than in the woven portion of the strap.

21. A method of making the load bearing system according to claim 1, said method comprising:
weaving an upstream portion of the strap by interlacing said at least one weft yarn with said warp yarns;
interrupting said weaving by discontinuing said interlacing of said at least one weft yarn to thereby create said non-woven portion of said strap.

22. A method according to claim 21, said method further comprising:
after said interrupting said weaving, resuming said weaving to create a downstream portion of the strap.

23. A method of making the load bearing system according to claim 1, said method comprising:
removing every one of at least one weft yarn along a portion of an initially continuously woven strap to produce said non-woven portion of said load-bearing textile strap.

24. A method according to claim 21, said method further comprising:
spreading apart adjacent pairs of said warp yarns in said non-woven portion of the strap; and
securing said adjacent pairs of warp yarns in a spread-apart configuration.

25. A method according to claim 24, wherein:
said securing said adjacent pairs of warp yarns in a spread-apart configuration comprises stitching said spread-apart warp yarns to a support surface.

26. A method according to claim 24, wherein:
said securing said adjacent pairs of warp yarns in a spread-apart configuration comprises adhesively bonding said spread-apart warp yarns to a support surface.

27. A method according to claim 23, said method further comprising:
spreading apart adjacent pairs of said warp yarns in said non-woven portion of the strap; and
securing said adjacent pairs of warp yarns in a spread-apart configuration.

28. A method according to claim 27, wherein:
said securing said adjacent pairs of warp yarns in a spread-apart configuration comprises stitching said spread-apart warp yarns to a support surface.

29. A method according to claim 27, wherein:
said securing said adjacent pairs of warp yarns in a spread-apart configuration comprises adhesively bonding said spread-apart warp yarns to a support surface.

30. A load bearing system comprising:
a load-bearing textile strap comprising warp yarns and at least one weft yarn;

said strap comprising a woven portion, said woven portion comprising a plurality of adjacent pairs of warp yarns extending along a longitudinal direction of the strap interlaced with said at least one weft yarn;

said strap further comprising a non-woven portion, said non-woven portion of the strap comprising no weft yarn;

in said non-woven portion of the strap, of said plurality of adjacent pairs of warp yarns being transversely spread apart to provide the non-woven portion of the strap with an increased width relative to a width of the woven portion of the strap; said plurality of adjacent pairs of warp yarns being maintained transversely spread apart by: adhesive bonding, or being attached to a support surface with stitches.

* * * * *